US009590295B2

(12) United States Patent
Yanagi

(10) Patent No.: US 9,590,295 B2
(45) Date of Patent: Mar. 7, 2017

(54) ANTENNA APPARATUS

(71) Applicant: FUJITSU COMPONENT LIMITED, Tokyo (JP)

(72) Inventor: Masahiro Yanagi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 220 days.

(21) Appl. No.: 14/281,983

(22) Filed: May 20, 2014

(65) Prior Publication Data

US 2014/0347250 A1 Nov. 27, 2014

(30) Foreign Application Priority Data

May 27, 2013 (JP) ..... 2013-111242

(51) Int. Cl.

| | |
|---|---|
| ***H01Q 1/00*** | (2006.01) |
| ***H01Q 1/38*** | (2006.01) |
| *H01Q 1/24* | (2006.01) |
| *H01Q 9/42* | (2006.01) |

(52) U.S. Cl.

CPC ..... *H01Q 1/38* (2013.01); *H01Q 1/243* (2013.01); *H01Q 9/42* (2013.01)

(58) Field of Classification Search

CPC ..... H01Q 1/20; H01Q 1/241; H01Q 9/0407; H01Q 21/10; H01Q 1/38

USPC ..... 343/904, 813, 815, 817

See application file for complete search history.

(56) References Cited

U.S. PATENT DOCUMENTS

| | | | | |
|---|---|---|---|---|
| 3,889,268 | A * | 6/1975 | Peters | H01Q 9/14 343/703 |
| 5,710,984 | A * | 1/1998 | Millar | H04B 1/18 343/702 |
| 2007/0001924 | A1* | 1/2007 | Hirabayashi | H01Q 19/32 343/893 |
| 2010/0295569 | A1* | 11/2010 | Chu et al. | H01Q 19/32 343/893 |
| 2012/0274538 | A1* | 11/2012 | Tsou et al. | G01R 31/2822 324/750.01 |

FOREIGN PATENT DOCUMENTS

| | | |
|---|---|---|
| JP | 2004-364023 | 12/2004 |

* cited by examiner

*Primary Examiner* — Graham Smith
*Assistant Examiner* — Collin Dawkins
(74) *Attorney, Agent, or Firm* — IPUSA, PLLC

(57) ABSTRACT

An antenna apparatus includes an antenna element connected to a power feed point, a parasitic element disposed to overlap the antenna element as viewed from above and configured to be coupled to the antenna element, and a switch connected to the parasitic element and configured to switch connections to connect the parasitic element either to a given potential point or to a test-purpose terminal.

10 Claims, 6 Drawing Sheets

100A
110
150A
120
150B
151

100B
110
150A
120
150B
151

100C
110
120
150C
151
Z
Y
X

ANTENNA APPARATUS

BACKGROUND OF THE INVENTION

1. Field of the Invention

The disclosures herein relate to an antenna apparatus.

2. Description of the Related Art

A wireless communications module is known in the art that includes a wireless unit for wireless communication and a control unit for controlling the wireless unit (see Japanese Patent Application Publication No. 2004-364023). Such a wireless communications module may be configured to include an antenna feed unit that utilizes a connector with a switch to connect an antenna to a transmission and reception unit of the wireless unit disposed on a printed-circuit board, on which the wireless communications module is implemented.

In such a wireless communications module having the configuration described above, the antenna feed unit utilizes a connector with a switch for connection to the transmission and reception unit of the wireless unit. With this arrangement, transmission loss occurs between the wireless unit and the antenna.

Accordingly, it may be desirable to provide an antenna apparatus in which transmission loss is small.

SUMMARY OF THE INVENTION

It is a general object of the present invention to provide an antenna apparatus that substantially obviates one or more problems caused by the limitations and disadvantages of the related art.

According to an embodiment, an antenna apparatus includes an antenna element connected to a power feed point, a parasitic element disposed to overlap the antenna element as viewed from above and configured to be coupled to the antenna element, and a switch connected to the parasitic element and configured to switch connections to connect the parasitic element either to a given potential point or to a test-purpose terminal.

According to at least one embodiment, an antenna apparatus having small transmission loss is provided.

BRIEF DESCRIPTION OF THE DRAWINGS

Other objects and further features of the present invention will be apparent from the following detailed description when read in conjunction with the accompanying drawings.

DESCRIPTION OF THE PREFERRED EMBODIMENTS

A description will be given of a related-art antenna apparatus before providing a description of embodiments of an antenna apparatus according to this disclosure.

Figure 1B:
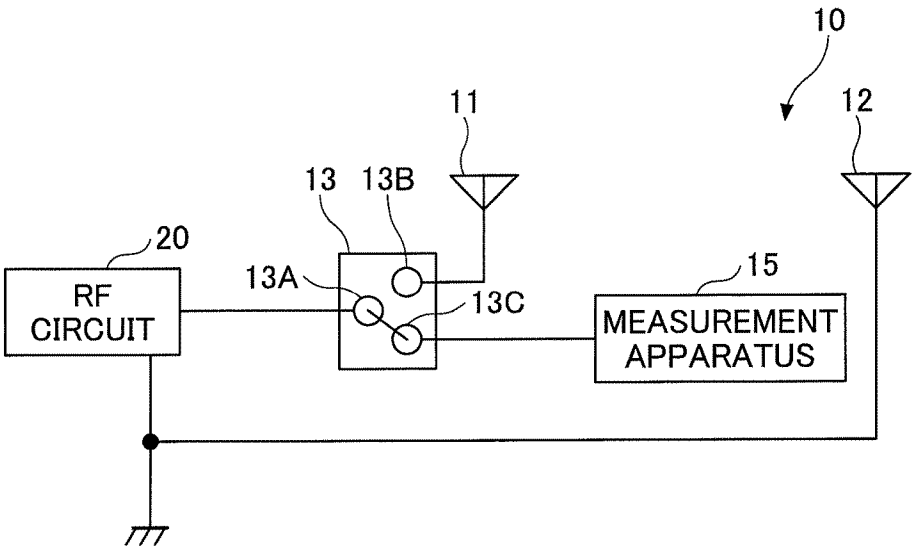
FIGS. 1A and 1B are drawings illustrating a related-art antenna apparatus.
Figure 1A:
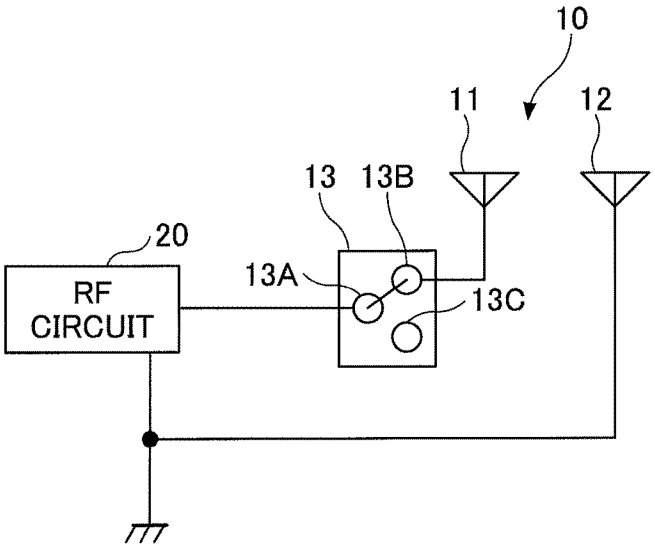

FIGS. 1A and 1B are drawings illustrating a related-art antenna apparatus 10. FIG. 1A illustrates the way the antenna apparatus 10 is set up at the time of wireless communication, and FIG. 1B illustrates the way the antenna apparatus 10 is set up at the time of test.

As illustrated in FIG. 1A, the related-art antenna apparatus 10 includes an antenna element 11, a parasitic element 12, and a switch 13. The antenna apparatus 10 is of a dipole type that includes the antenna element 11 and the parasitic element 12. The antenna element 11 behaves as a monopole antenna by establishing a coupling with a ground element (i.e., ground plane: not shown).

The antenna element 11 is connected to an RF circuit 20 through the switch 13. The antenna element 11 receives power from the RF circuit 20 to perform communication when connected to the RF circuit 20 through the switch 13.

The parasitic element 12 is disposed in proximity of the antenna element 11, and is coupled to the antenna element 11. The parasitic element 12 is not connected to the RF circuit 20. The parasitic element 12 is connected to a ground potential. The parasitic element 12 resonates with the antenna element 11 when the antenna element 11 is connected to the RF circuit 20 through the switch 13. The resonance frequency of the antenna element and the parasitic element 12 is set to a predetermined frequency such as 2.45 GHz, for example.

The RF circuit 20 is connected to the antenna element 11 through the switch 13 to feed power to the antenna element 11.

The switch 13 is of a three-terminal type that has three terminals 13A, 13B and 13C. The terminal 13A is connected to the RF circuit 20, and the terminal 13B is connected to the antenna element 11, with the terminal 13C serving as a testing terminal (i.e., test-purpose terminal). The switch 13 switches connections to connect the RF circuit 20 either to the terminal 13B or to the terminal 13C.

In the antenna apparatus 10, the terminal 13A of the switch 13 is connected to the terminal 13B as illustrated in FIG. 1A at the time of wireless communication. In this state, the antenna element 11 is connected to the RF circuit 20, so that the antenna apparatus 10 can perform wireless communication through the antenna element 11 and the parasitic element 12.

In the antenna apparatus 10, the terminal 13A of the switch 13 is connected to the terminal 13C as illustrated in FIG. 1B at the time of a test. Further, a measurement apparatus 15 is connected to the terminal 13C. In this state, the measurement apparatus 15 can perform a wireless test in which the inputs or outputs of the RF circuit 20 are measured.

As described above, the related-art antenna apparatus 10 has the switch 13 that is switched over, depending on whether wireless communication is performed or the RF circuit 20 is tested.

In the following, embodiments to which an antenna apparatus of this disclosure is applied will be described.

Figure 2B:
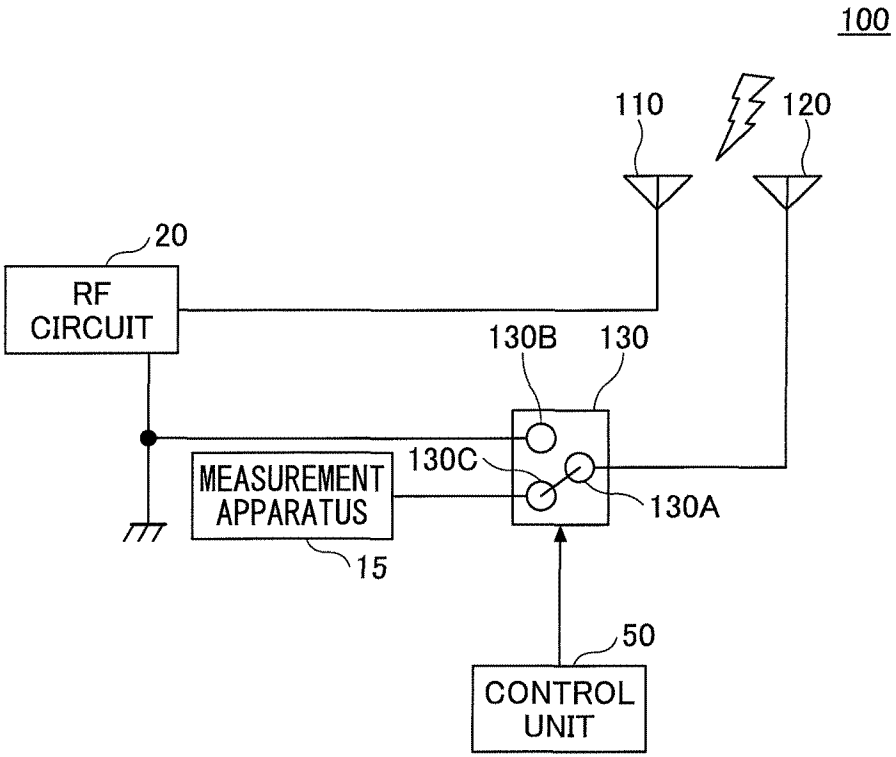
FIGS. 2A and 2B are drawings illustrating an antenna apparatus according to an embodiment.
Figure 2A:
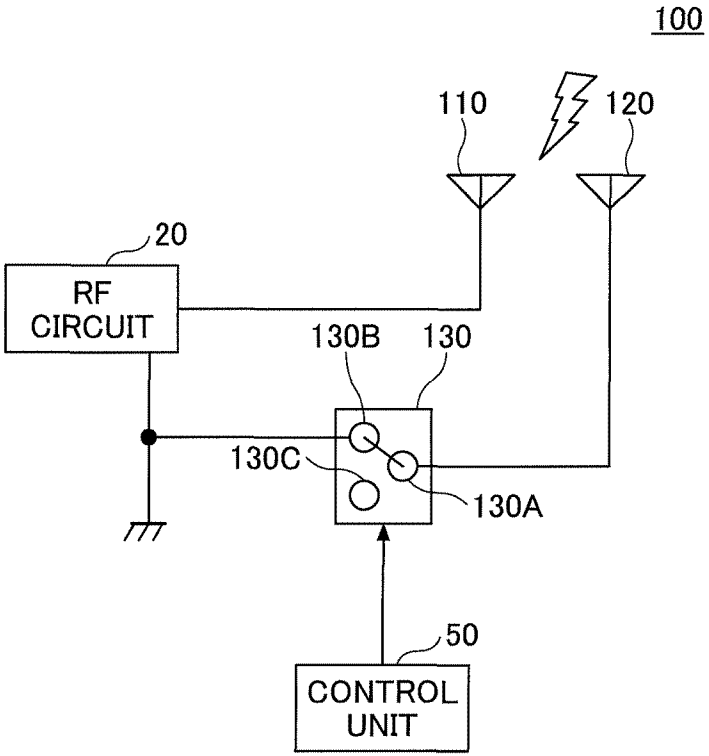

FIGS. 2A and 2B are drawings illustrating an antenna apparatus 100 according to an embodiment.

The antenna apparatus 100 includes an antenna element 110, a parasitic element 120, and a switch 130. The antenna apparatus 100 is of a dipole type that includes the antenna element 110 and the parasitic element 120. The antenna element 110 behaves as a monopole antenna by establishing a coupling with a ground element (i.e., ground plane: not shown).

The antenna element 110 is directly connected to the RF circuit 20. The antenna element 110 receives power from the RF circuit 20 to perform communication. The RF circuit 20 is the same as or similar to the RF circuit 20 illustrated in FIG. 1.

The parasitic element 120 is disposed in proximity of the antenna element 110, and is coupled to the antenna element 110. The parasitic element 120 is connected to a terminal 130A of the switch 130.

In order for the antenna apparatus 100 to perform wireless communication, the terminal 130A of the switch 130 is connected to a terminal 130B to couple the parasitic element 120 to the ground as illustrated in FIG. 2A. In order to perform a test on the antenna apparatus 100, the terminal 130A of the switch 130 is connected to a terminal 130C as illustrated in FIG. 2B. In this state, the measurement apparatus 15 may be connected to the terminal 130C, so that the parasitic element 120 is connected to the measurement apparatus 15.

The parasitic element 120 resonates with the antenna element 110 when the antenna element 110 performs communication. The resonance frequency of the antenna element 110 and the parasitic element 120 is set to a predetermined frequency such as 2.45 GHz, for example.

The switch 130 is of a three-terminal type that has the three terminals 130A, 130B and 130C. A coaxial switch may be used as the switch 130, for example. Alternatively, the switch 130 may be an integrated circuit device, which may be implemented in a chip that includes other circuits. The terminal 130A is connected to the parasitic element 120. The terminal 130B is connected to a ground potential point. The ground potential point to which the terminal 130B is connected is the same as the ground potential point to which the ground terminal of the RF circuit 20 is connected. The terminal 130C is a test-purpose terminal.

The switch 130 is switched over by a control unit 50 in order to connect the terminal 130A to either the terminal 130B or the terminal 130C. The control unit 50 also serves to control the wireless apparatus that includes the antenna apparatus 100.

In order for the antenna apparatus 100 of the present embodiment described above to perform wireless communication, the terminal 130A of the switch 130 is connected to the terminal 130B to couple the parasitic element 120 to the ground as illustrated in FIG. 2A. The parasitic element 120 is connected to the same ground potential point as the ground terminal of the RF circuit 20.

In this state, the antenna element 110 receives power from the RF circuit 20 to perform communication. Because the antenna element 110 and the parasitic element 120 are coupled to each other, the parasitic element 120 performs communication through the antenna element 110.

In order for the antenna apparatus 100 of the present embodiment to perform a test on the RF circuit 20, the terminal 130A of the switch 130 is connected to the terminal 130C, which is in turn connected to the measurement apparatus 15. With this arrangement, the parasitic element 120 is connected to the measurement apparatus 15. Since the antenna element 110 is coupled to the parasitic element 120, the measurement apparatus 15 can measure the output of the RF circuit 20 through the parasitic element 120 and the antenna element 110.

In the antenna apparatus 100 of the present embodiment described above, no transmission loss that would be attributable to the switch 130 occurs between the antenna element 110 and the RF circuit 20 when performing wireless communication. Accordingly, the present embodiment can provide an antenna apparatus 100 having small transmission loss.

In other words, transmission loss is significantly lowered compared with the related-art antenna apparatus 10 in which the switch 13 is in existence between the antenna element 11 and the RF circuit 20 at the time of wireless communication.

Further, the parasitic element 120 does not directly receive power from the RF circuit 20 at the time of wireless communication by the antenna apparatus 100, so that transmission loss is ignorable.

Moreover, since the parasitic element 120 is coupled to the antenna element 110 due to the positioning thereof close to the antenna element 110, loss that occurs between the antenna element 110 and the parasitic element 120 at the time of conducting a test on the RF circuit 20 is miniscule. Additionally, loss that occurs between the antenna element 110 and the parasitic element 120 at the time of testing the RF circuit 20 can be corrected after measurement by the measurement apparatus 15. The test results are thus not affected by such loss.

In the following, a description will be given of the configuration in which the antenna apparatus 100 is embedded in an electronic apparatus such as a digital camera having a metal cuboid case.

Figure 3:
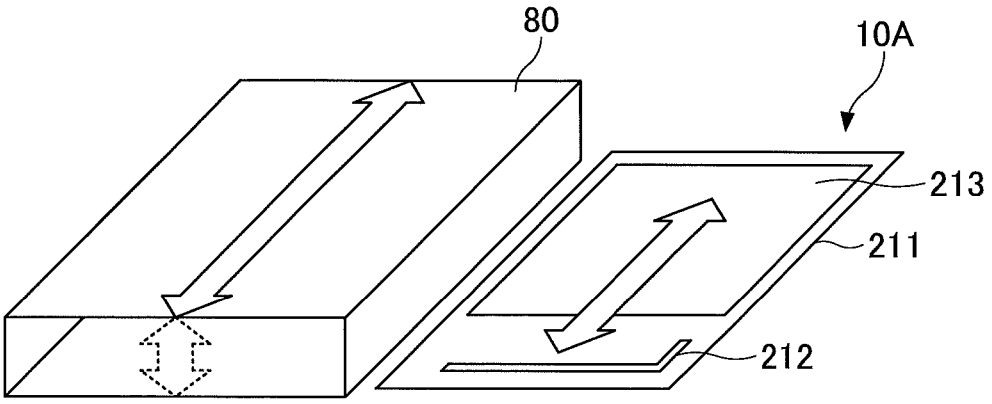
FIG. 3 is a drawing illustrating the directions of electric fields generated by an antenna apparatus when the antenna apparatus is embedded in an electronic apparatus.

FIG. 3 is a drawing illustrating the directions of electric fields generated by an antenna apparatus when the antenna apparatus is embedded in an electronic apparatus. FIG. 3 illustrates a cuboid case 80 and a related-art antenna apparatus 10A. In FIG. 3, for the sake of convenience of explanation, the antenna apparatus 10A that is in reality accommodated inside the case 80 is illustrated on the right-hand side of the case 80. The case 80 behaves like a waveguide because of its hollow cuboid shape.

The related-art antenna apparatus 10A includes an antenna element 212 and a ground element 213 formed on a surface of a substrate 11. The antenna element 212 has an L-letter shape as viewed from above, and the ground element 213 has a rectangular shape as viewed from above.

As power is fed to the antenna element 212 of the related-art antenna apparatus 10A, an electric field is generated on the antenna apparatus 10A in the direction as indicated by a solid-line arrow. This direction corresponds to the direction indicated by a solid-line arrow in the case 80.

With the electric field generated in the direction indicated by the solid-line arrows, an electric wave does not propagate inside the case 80 that behaves as a waveguide. Since the electric wave does not reach an opening of the case 80, no electric wave is transmitted form the opening.

On the other hand, with an electric field generated in the direction indicated by a dotted-line arrow, i.e., the direction (i.e., the thickness direction of the case 80) perpendicular to the direction indicated by the solid-line arrows, an electric wave propagates inside the case 80 and radiates from the opening of the case 80. This is because the direction indicated by the dotted-line arrow is close to the excitation direction of the TE10 mode.

In consideration of this, the antenna apparatus 100 (see FIGS. 2A and 2B) of the embodiment is configured such that the antenna element 110 and the parasitic element 120 are arranged to generate an electric field having an excitation direction in the direction indicated by the dotted-line arrow.

Figure 4B:
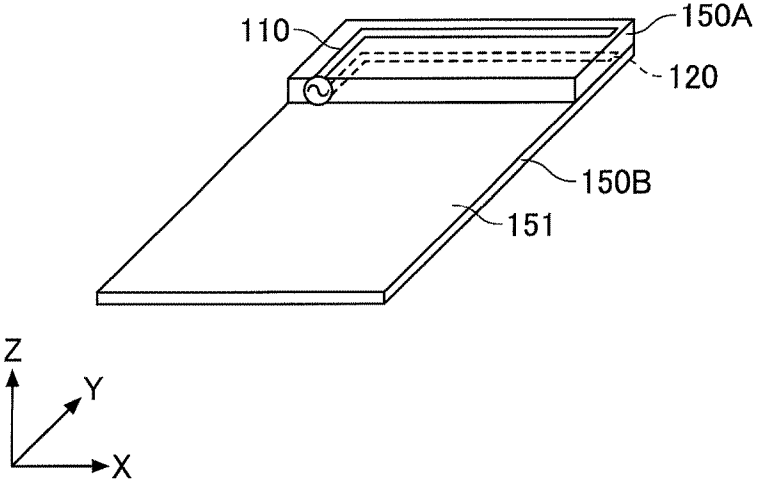
FIGS. 4A and 4B are drawings illustrating the positional relationship between an antenna element and a parasitic element included in the antenna apparatus of the embodiment.
Figure 4A:
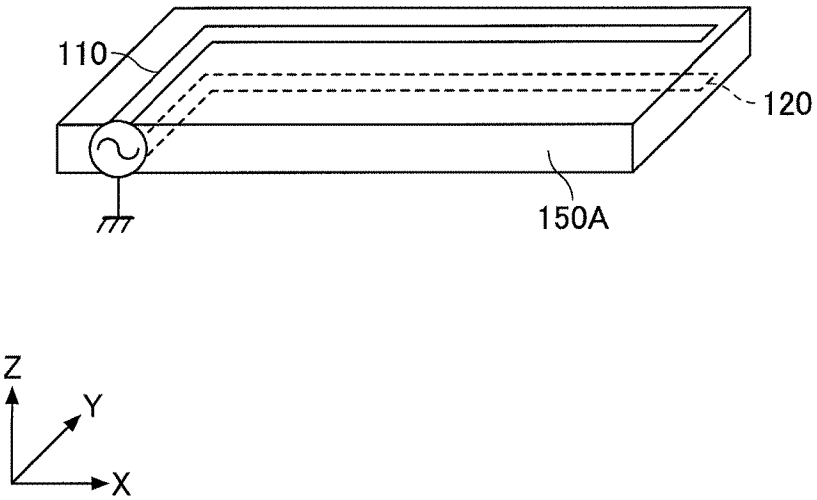

FIGS. 4A and 4B are drawings illustrating the positional relationship between the antenna element 110 and the parasitic element 120 included in the antenna apparatus 100 of the present embodiment. In FIGS. 4A and 4B, an XYZ coordinate system, as an example of an orthogonal coordinate system, is defined.

As illustrated in FIG. 4A, the antenna element 110 and the parasitic element 120 are attached to a front surface (i.e., an upper surface in FIG. 4A) and a back surface (i.e., a lower surface in FIG. 4A), respectively, of a printed-circuit board 150A, for example.

Each of the antenna element 110 and the parasitic element 120 has an L-letter shape as viewed from above. The antenna element 110 and the parasitic element 120 are formed on the front surface and the back surface, respectively, of the printed-circuit board 150A such that they completely overlap each other as viewed from above (i.e., in an X-Y plane view). Each of the antenna element 110 and the parasitic element 120 is formed in an L-letter shape along a short side and a long side of the printed-circuit board 150A that is rectangular as viewed from above.

In FIG. 4A, the point of power feeding to the antenna element 110 is indicated by a symbol for representing an alternate-current power supply. The point of power feeding is connected to one end of the antenna element 110, and is not connected to the parasitic element 120.

The printed-circuit board 150A is a substrate complying with the FR-4 (i.e., flame retardant type 4) standard, for example. The antenna element 110 and the parasitic element 120 are formed by patterning copper foils attached to the front surface and the back surface, respectively, of the FR-4 substrate.

Further, as illustrated in FIG. 4B, the printed-circuit board 150A on which the antenna element 110 and the parasitic element 120 are formed may be mounted on another printed-circuit board 150B. The printed-circuit board 150B has the same width (i.e., the length in the X-axis direction) as the printed-circuit board 150A, a length (i.e., the length in the Y-axis direction) longer than the length of the printed-circuit board 150A, and the width (i.e., the length in the Z-axis direction) equal to the width of the printed-circuit board 150A. The printed-circuit board 150B has a ground element 151 formed on a surface thereof in an area other than the area where the printed-circuit board 150A having the antenna element 110 and the parasitic element 120 formed thereon is mounted.

The ground element 151 may be connected to the parasitic element 120. Further, the antenna element 110 is coupled to the ground element 151 to behave as a monopole antenna.

The RF circuit 20 and the control unit 50 may be mounted on the ground element 151 formed on the printed-circuit board 150B. Circuits of the wireless apparatus inclusive of the antenna apparatus 100 may be mounted on the ground element 151 in addition to the RF circuit 20 and the control unit 50.

Figure 5B:
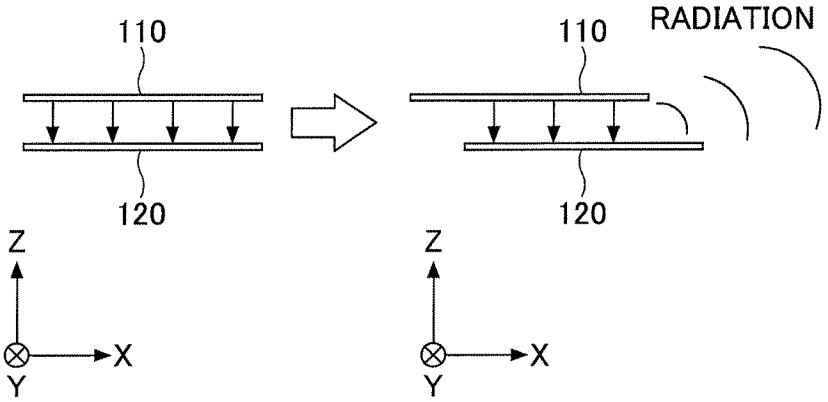
FIGS. 5A and 5B are drawings illustrating the direction of an electric field generated between the antenna element and the parasitic element illustrated in FIGS. 4A and 4B.
Figure 5A:
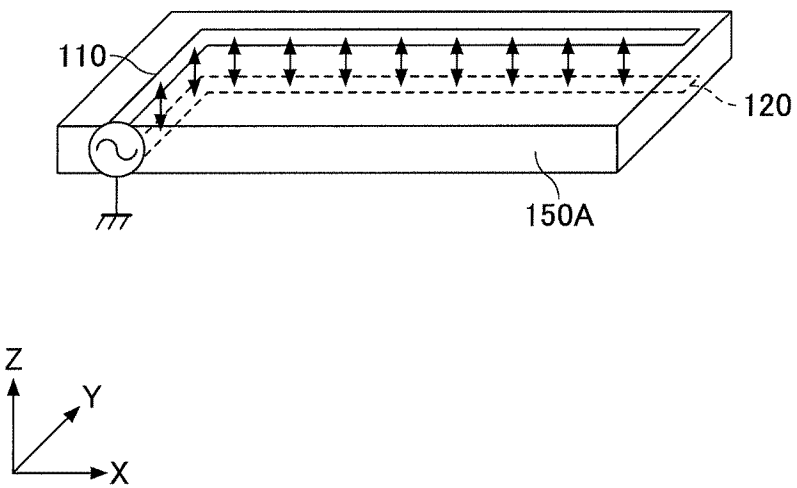

FIGS. 5A and 5B are drawings illustrating the direction of an electric field generated between the antenna element 110 and the parasitic element 120 illustrated in FIGS. 4A and 4B.

As illustrated in FIG. 5A, the electric field generated between the antenna element 110 and the parasitic element 120 extends in the Z-axis direction.

Further, as illustrated in FIG. 5B, the antenna element 110 and the parasitic element 120 may be slightly displaced from each other in the X-Y plane. A displacement may be made to such an extent that the antenna element 110 and the parasitic element 120 still have an overlapping portion as viewed from above (i.e., in the X-Y plan view). Namely, the antenna element 110 and the parasitic element 120 may be displaced from each other such that an overlapping portion is still in existence therebetween as viewed from above (i.e., in the X-Y plan view).

Creating a displacement between the antenna element 110 and the parasitic element 120 such as to maintain an overlap as viewed from above (i.e. in the X-Y plan view) can increase the amount of electric wave that radiates from a gap between the antenna element 110 and the parasitic element 120 in the X-Y plane directions.

Figures 6A, 6B, 6C:
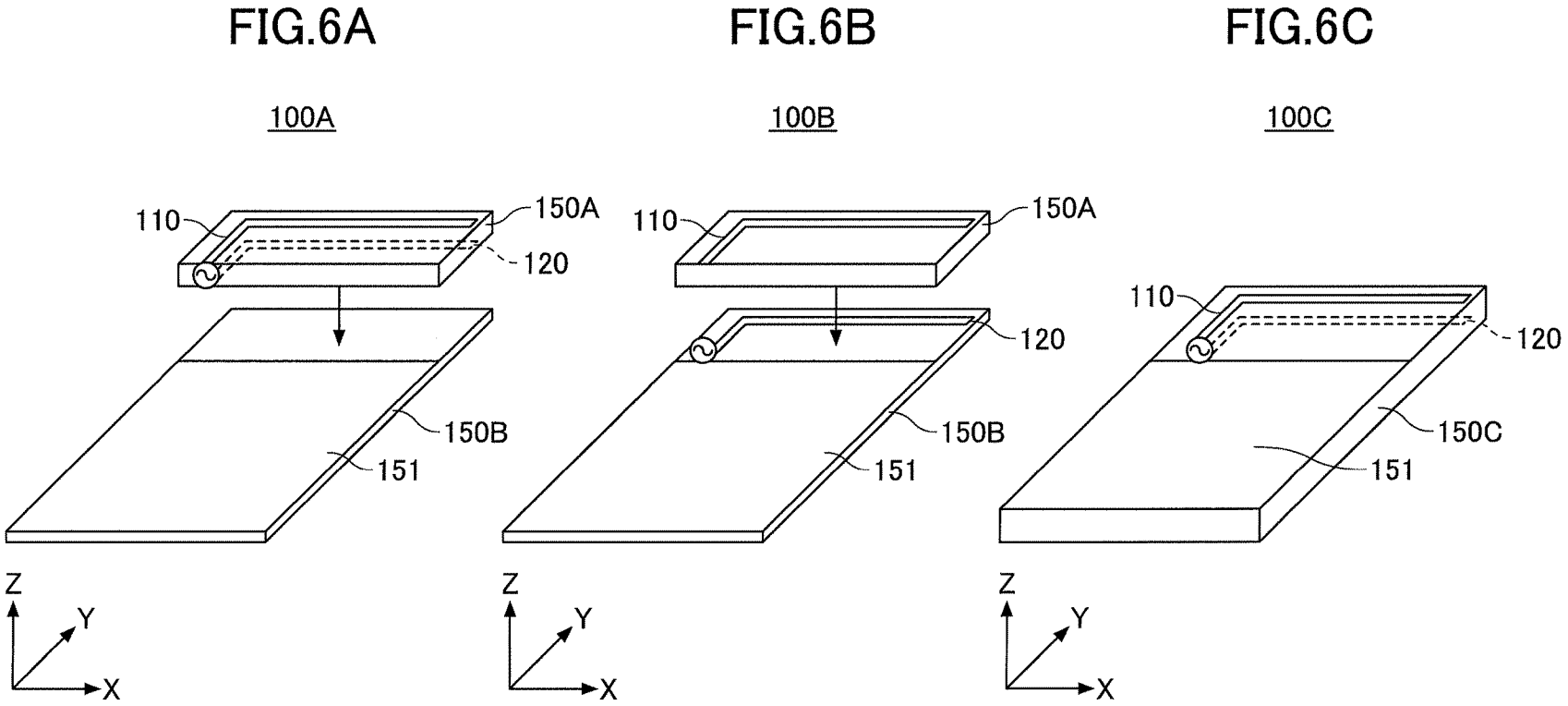
FIGS. 6A through 6C are drawings illustrating antenna apparatuses according to embodiments.

FIGS. 6A through 6C are drawings illustrating antenna apparatuses 100A, 100B and 100C according to embodiments. In FIGS. 6A and 6B, the printed-circuit boards 150A and 150B are illustrated in a separated state in order to clearly depict the configuration of the antenna apparatuses 100A and 100B.

An antenna apparatus 100A illustrated in FIG. 6A is similar to what is illustrated in FIG. 4B. The printed-circuit board 150A having the antenna element 110 and the parasitic element 120 formed thereon is mounted on another printed-circuit board 150B. The antenna element 110 is formed on the front surface (i.e., the surface facing the positive Z-axis direction) of the printed-circuit board 150A, and the parasitic element 120 is formed on the back surface (i.e., the surface facing the negative Z-axis direction) of the printed-circuit board 150A. Further, the ground element 151 is formed on the front surface (i.e., the surface facing the positive Z-axis direction) of the printed-circuit board 150B.

An antenna apparatus 100B illustrated in FIG. 6B is configured such that the parasitic element 120 is formed on the front surface of the printed-circuit board 150B. The antenna element 110 is formed on the front surface (i.e., the surface facing the positive Z-axis direction) of the printed-circuit board 150A, and the parasitic element 120 together with the ground element 151 is formed on the front surface (i.e., the surface facing the positive Z-axis direction) of the printed-circuit board 150B.

An antenna apparatus 100C illustrated in FIG. 6C is configured such that a printed-circuit board 150C is a multilayer substrate, and the antenna apparatus 100 and the ground element 151 are formed on the front surface (i.e., the surface facing the positive Z-axis direction) of the printed-circuit board 150C, with the parasitic element 120 being formed in an inner layer of the printed-circuit board 150C.

The above description has been given with respect to examples in which the antenna element 110 and the parasitic element 120 are formed on the printed-circuit board 150A, 150B, or 150C as illustrated in FIGS. 6A through 6C. They are not limiting examples, and the locations at which the antenna element 110 and the parasitic element 120 are formed are not limited to those illustrated in FIGS. 6A through 6C.

According to the embodiments described heretofore, transmission loss that would be attributable to the switch 130 does not occur between the antenna element 110 and the RF circuit at the time of wireless communication. The antenna apparatuses 100, 100A, 100B, and 100C are thus provided that have small transmission loss.

A description has been given with respect to an example in which the resonant frequency of the antenna element 110 and the parasitic element 120 is 2.45 GHz for use in a wireless LAN (i.e., local area network). This is not a limiting example, and the resonant frequency of the antenna element 110 and the parasitic element 120 may be a different frequency.

The descriptions of the diversity antenna apparatus of exemplary embodiments have been provided heretofore. The present invention is not limited to these embodiments, but various variations and modifications may be made without departing from the scope of the present invention.

The present application is based on and claims the benefit of priority of Japanese priority application No. 2013-111242 filed on May 27, 2013, with the Japanese Patent Office, the entire contents of which are hereby incorporated by reference.

What is claimed is:

1. An antenna apparatus, comprising:

an antenna element connected to a power feed point;

a parasitic element disposed to overlap the antenna element as viewed from above and configured to be coupled to the antenna element; and a switch connected to the parasitic element to electrically connect the parasitic element to a given potential point at a time of wireless communication, and to electrically connect the parasitic element to a test-purpose terminal at a time of a test while the antenna element is not connected to the test-purpose terminal through a wired connection, the test-purpose terminal being for connection to a measurement apparatus.

2. The antenna apparatus as claimed in claim 1, wherein the antenna element and the parasitic element are disposed on a surface of a dielectric layer and another surface of the dielectric layer, respectively.

3. The antenna apparatus as claimed in claim 1, further comprising a substrate, wherein the antenna element and the parasitic element are disposed on a surface of the substrate and another surface of the substrate, respectively.

4. The antenna apparatus as claimed in claim 1, further comprising:

a first substrate; and a second substrate stacked together with the first substrate, wherein the antenna element and the parasitic element are disposed on the first substrate and the second substrate, respectively, or disposed on a surface of the first substrate and another surface of the first substrate, respectively.

5. The antenna apparatus as claimed in claim 1, wherein the antenna element and the parasitic element are disposed to overlap each other only partially as viewed from above.

6. The antenna apparatus as claimed in claim 1, wherein the switch is a coaxial switch.

7. The antenna apparatus as claimed in claim 1, wherein the switch is an integrated circuit device.

8. The antenna apparatus as claimed in claim 1, further comprising a multilayer substrate, wherein the antenna element and the parasitic element are disposed on a surface of the multilayer substrate and in an inner layer of the multilayer substrate, respectively.

9. An antenna apparatus, comprising:

an antenna element connected to a power feed point;

a parasitic element disposed in proximity of the antenna element; and a switch having a first terminal, a second terminal, and a third terminal, the switch electrically connecting the first terminal to the second terminal in a first connection state and electrically connecting the first terminal to the third terminal in a second connection state, the first terminal being connected to the parasitic element, and the second terminal being connected to a ground potential point, so that the parasitic element is electrically connected to the ground potential point at a time of wireless communication, and is electrically connected to the third terminal at a time of a test, the third terminal being for connection to a measurement apparatus.

10. The antenna apparatus claimed in claim 9, further comprising a circuit configured to feed power to the antenna element through the power feed point.

* * * * *